United States Patent [19]

Braithwaite, Jr.

[11] 4,370,174

[45] Jan. 25, 1983

[54] METHOD FOR REMOVING ADHESIVE RESIDUES WITH AN EMULSION CLEANER

[76] Inventor: Charles H. Braithwaite, Jr., 11232 Tigrina, Whittier, Calif. 90603

[21] Appl. No.: 297,979

[22] Filed: Aug. 31, 1981

[51] Int. Cl.[3] ..... B08B 3/08; C11D 7/50

[52] U.S. Cl. ..... 134/7; 134/26; 134/38; 252/163; 252/164; 252/165; 252/167

[58] Field of Search ..... 134/7, 26, 38, 40; 252/140, 163, 164, 165, 167, 174.22, 312, DIG. 5

[56] References Cited

U.S. PATENT DOCUMENTS

| | | | |
|---|---|---|---|
| 2,317,038 | 4/1943 | Ellinger | 134/7 X |
| 3,214,867 | 11/1965 | Henning | 134/7 X |
| 3,523,826 | 8/1970 | Lissant | 134/40 X |
| 3,956,162 | 5/1976 | Lautenberger | 252/167 X |
| 3,983,078 | 9/1976 | Collins | 252/DIG. 14 X |
| 4,108,681 | 8/1978 | Lawson et al. | 134/40 X |

OTHER PUBLICATIONS

Atlas Surface Active Agents (1950), p. 22.

Brij Surfactants (1961), p. 4.

*Primary Examiner*—Marc L. Caroff

*Attorney, Agent, or Firm*—Fischer, Tachner & Strauss

[57] ABSTRACT

The invention comprises a cleaning composition and a method for its use in the removal of asphaltic, polyvinyl acetate, and rubber base adhesive coatings from floors. The coating removal composition comprises an organic solvent having a flash point above about 140 degrees F., an inorganic solid adsorbent powder, a water-in-oil surfactant in an amount sufficient to form an oil external phase emulsion and an oil-in-water surfactant in an amount sufficient to reverse the emulsion to a water external phase upon the addition of water thereto. The method of the invention comprises applying the composition to a substrate surface bearing an adhesive coating, permitting the cleaning composition to remain in contact with the adhesive coating on the substrate surface for a sufficient time to soften the adhesive, scrubbing the surface to loosen the adhesive coating and to work the loosened adhesive into the composition, adding water to the emulsion to reverse the emulsion phase and form a water dispersible residue, and removing the resultant water external phase emulsion from the substrate.

25 Claims, No Drawings

METHOD FOR REMOVING ADHESIVE RESIDUES WITH AN EMULSION CLEANER

BACKGROUND OF THE INVENTION

1. Field of Invention

This invention relates to cleaning compositions and methods for their use and, in particular, to such compositions and methods for removing tile and flooring adhesives from floors.

2. Brief Statement of the Prior Art

When tile, seamless flooring and other sheet goods used as floor covering is replaced, the removal of the floor covering exposes an adhesive residue which, typically is of an asphaltic, polyvinyl acetate, or rubber base composition. Usually the residue is a hard solid having an oxidized surface. In instances where the original application was sufficiently thick, the residue may additionally have a soft plastic consistency beneath the solidified, oxidized surface. It is necessary to remove the adhesive residue since the residue causes unevenness in subsequent flooring and interferes with vinyl adhesives.

The material is presently chiefly removed with mechanical grinding, a labor intensive operation, particularly when the original adhesive has been applied in a relatively thick coating. Some attempts have been made to reduce the mechanical work required by treatment of the adhesive residue with solvents, however, these attempts have not been successful and widely accepted because of the hazardous nature of the solvents which is particularly acute when working in confined areas.

In the development of this invention, we have attempted to reduce the hazards associated with solvents by the addition of solid adsorbent powder with the solvents. While this results in the formation of a dry or solid mixture with the solvent and dissolved adhesive residues adsorbed onto the solid powder, difficulties are still experienced with flameability and toxicity of volatile solvents. We have also attempted to eliminate these problems by using water-solvent emulsions, however, these have generally lacked adequate solvency for efficient adhesive removal.

BRIEF STATEMENT OF THE INVENTION

This invention comprises a cleaning composition and a method for its use to remove adhesive residues from floors, particularly during the removal of flooring such as tile and sheet goods used as floor covering such as linoleum, seamless flooring, and the like. The composition comprises: (1) an organic solvent, preferably an aromatic solvent, having a high flash point, above about 140 degrees F.; (2) a minor amount of an inorganic solid adsorbent powder; (3) a water-in-oil surfactant in an amount sufficient to form an oil external phase emulsion of said composition; and (4) an oil-in-water surfactant sufficient to reverse the emulsion to a water external phase upon addition of water thereto. The method of the invention comprises applying the cleaning composition to the substrate surface having adhesive residues thereon, permitting the cleaning composition to remain in contact with the adhesive residues for a sufficient time to soften these residues, scrubbing or scouring the surface to loosen the adhesive residues and to work the loosened residues into the solvent of the composition, subsequently adding water to the emulsion in an amount sufficient to reverse the emulsion external phase and form a water dispersible emulsion, and thereafter draining or removing the resultant emulsion from the substrate, and cleaning the substrate surface to leave a clean surface receptive to the application of fresh adhesives.

DESCRIPTION OF PREFERRED EMBODIMENTS

This invention comprises a cleaning composition and a method of its use to remove adhesive residues such as asphaltic, polyvinyl acetate and rubber base adhesives from a substrate surface such as a floor. The composition is intended for the cleaning of used and aged adhesive residues from a floor during reflooring, after the tile or seamless flooring has been removed from the floor.

The cleaning composition of the invention has the constitution set forth in Table I. Briefly, the cleaning composition comprises from 45 to 80 weight percent of an organic solvent, preferably an aromatic solvent, which is present in sufficient quantities and has sufficient solvency for the adhesive residues that the composition when applied will soften and loosen such residues from a floor. The composition also contains from 20 to 55 weight percent of an inorganic solid adsorbent powder which is preferably sufficiently subdivided to pass approximately a 20 mesh screen. Optionally, the composition can also contain from 0 to about 20 weight percent water.

The composition is formed into an oil external phase emulsion by a sufficient quantity of a water-in-oil surfactant. The oil external phase of the emulsion insures that the organic solvent is exposed to the adhesive residues. The invention also comprises the presence of a sufficient quantity of an oil-in-water surfactant to reverse the external phase of the emulsion upon addition of water thereto so that the emulsion, after the asphaltic residues have been loosened and dissolved in the solvent, can be readily cleaned from the surface to obtain a clean floor which has a neutral wetability and is in a condition to receive subsequent applications of adhesives.

The method of the invention comprises the application of the cleaning composition to a floor surface after the tile, linoleum, or seamless flooring and the like has been removed from the surface. The removal of the floor covering from the surface of a floor will leave adhesive residues on the floor. Typically the adhesive residues which remain on the floors following the removal of the flooring comprise hard solid residues of asphaltic or rubber base adhesives. The surfaces of the adhesive residues are usually oxidized and if the original application employed a thick coating of adhesive, the residues can have a soft or plastic consistency beneath the oxidized and solidified surface. These residues must be removed since they interfere with subsequently applied adhesives and cause unevenness in subsequent floor coverings.

The cleaning composition of the invention is applied to this surface at a variable rate, dependent upon the condition of the floor and the amount of asphaltic residues thereon. Generally, however, the rate of application will be sufficient to apply one gallon over approximately 25 to 150 square feet. The cleaning composition can be poured directly onto the floor and spread with a stiff bristle broom and the like and is permitted to remain on the floor for a sufficient time to soften and dissolve the adhesive residues. Typically the composition will soften and dissolve most adhesive residues in a period from 10 to about 30 minutes, preferably from 10 to about 15 minutes. The time for softening adhesive residues can be shortened somewhat by mechanical working of the residues while in contact with the cleaning composition, typically by brushing or scouring the residues with a broom or rake to hasten the loosening of the adhesive residues and the solution of the residues in the organic solvent.

The cleaning composition when applied to the floor in a proper fashion will have a thin, semi-solid consistency with the ability to peak like whipped egg whites. After a sufficient time has been provided to loosen the asphaltic residues, the emulsion can be removed and, for this purpose, water is agitated into the mixture using a broom. Typically from 1 to about 10 volumetric proportions of water are added per volume of the cleaning emulsion composition and this is sufficient to reverse the external phase of the emulsion, forming a water external phase. The resultant emulsion can then be removed from the floor using a wet vacuum or otherwise washing and draining of the floor surface.

Often, an oily film remains on the floor surface after removal of the cleaning composition. Preferably this is removed by washing the floor with water and a mild oil-in-water surfactant. The resultant surface will then have neutral wetability and will be very receptive to subsequent applications of adhesives for newly applied flooring materials.

The treatment with the cleaning composition of the invention leaves a clean floor in which all traces of the adhesive residues have been removed. The surface of the floor is left with a neutral wetability and is ready to accept application of any of the common or conventional adhesive coatings, preparatory to the application of a new floor covering.

The following table illustrates the ingredients, in weight percentages of compositions useful as cleaning compositions of the invention:

TABLE I

| Ingredient | Broad | Preferred |
|---|---|---|
| Organic Solvent | 40–80% | 50–60% |
| Solid adsorbent | 20–60 | 40–50 |
| Water-in-oil surfactant | 0.002–0.1 | 0.004–0.006 |
| Oil-in-water surfactant | 0.001–0.05 | 0.002–0.003 |
| Water (optional) | 0–20 | 0–2 |

Useful solvents for the cleaning compositions of the invention comprise solvents having a high solvency for asphaltic, polyvinyl acetate and rubber base adhesives. Typically these can be aliphatic, alicyclic or aromatic compounds which preferably have a high flash point, typically above about 140 degrees F. and preferably above 190 degrees F. The solvents can be hydrocarbon, or can be halogenated, e.g., chlorinated or can be nitrogen containing such as amino or amido compounds, or oxygen containing such as hydroxo or oxo compounds, etc. The aromatic compounds useful in the invention can comprise the aromatics having from 1 to about 3 alkyl groups having from 5 to about 15 carbons such as alkyl benzenes, alkyl pyridines, alkyl furans, alkyl pyrozoles, alkyl piperidines, etc. and these compounds can contain from 1 to about 3 substituent groups such as amino, amido, hydroxo, oxo, halo, e.g., chloro, fluoro groups, etc. The aromatics can also include polynuclear aromatics and these can contain from 1 to about 3 alkyl groups having from 1 to about 10 carbons, e.g., alkyl naphthalenes, alkyl benzopyridines, chloronaphthalenes, etc.

The solvents can also be selected from aliphatic hydrocarbons and substituted hydrocarbons having from 1 to about 5 amino, amido, hydroxo, oxo, or halo groups or can be alicyclic hydrocarbons such as cyclopentane, cyclohexane, cyclooctane, etc. which have substituents such as from 1 to about 3 alkyl groups of 1 to about 10 carbons, or amino, amido, hydroxo, oxo or halo groups.

Examples of specific industrial solvents which are useful in the invention include acetophenone, N-acetyl morpholine, triisopropylbenzene, 4-aminobenzophenone, aminoethyl ethanolamine, parabromophenol, bromotoluene, butyl carbitol, dibutyl cresol, dibenzyl sulfide, dichlorophenol, dimethyl formamide, dichlorobenzophenone, dimethylpiperazine, 1,1-diphenyl ethane, ethyl diphenyl ether, ethylphenol, heptadecanol, dodecylmercaptan, di-tert-butylcresol, durene, octadecylamine, pentachlorethanol, piperazine, tetradecanol, naphthalene, dimethylnaphthalene, dioctylamine, stearamide, 2,6-diaminoheptadecane, 1,5,7-triaminododecane, di(2,4-dimethyloctyl) ketone, etc. Many commercially available solvents are distillate fractions and are mixtures of compounds, particularly the various mineral oil fractions and distillates which are hydrocarbon mixtures. A commonly used designation of these is the kauri-butanol value which indicates the aromaticity of the mixture. Preferably aromatic solvents, i.e., those having a kauri-butanol value above about 50 and preferably above 80 are used. Designation of this value and the flash point of the solvent is a fairly precise identification of useful and preferred hydrocarbon solvents.

The surfactants which can be used in the invention include cationic, anionic and non-ionic surfactants. The correct surfactant can be selected by use of the HLB system, a numerical rating of the hydrophile-lithophile balance of the surfactant. Surfactants with low number values, e.g., from 1.8 to about 8.5 are lipophilic and form water-in-oil emulsions. Surfactants with higher number values, e.g., from 9.0 to about 17, are hydrophilic and form oil-in-water emulsions. These numerical values correspond to the surfactant structure, e.g., those with long hydrocarbon chains and/or a limited number of polar groups are lithophilic while those with short or low molecular weight hydrocarbon groups and/or multiple polar groups are hydrophilic.

Examples of the cationic surfactants include: fatty amines, e.g., dodecylamine, octadecylamine; alkarylamines, e.g., dodecyl aniline; fatty amides such as fatty imidazolines, e.g., undecylimidazoline prepared by condensing lauric acid with ethylene diamine; quaternary alkyl and aryl ammonium salts and hydrates, e.g., cetyltriethyl ammonium cetyl sulfate; quaternary ammonium bases of fatty amines of disubstituted diamines, e.g., oleyl methylamino ethylene diethylamine methyl sulfate.

Examples of useful anionic surfactants include the following: fatty acid glyceride sulfonates and fatty acid sulfonates, e.g., sulfonated cottonseed oil, sulfonated oleic acid sulfonated sperm oil, sulfonated tallow, etc.; sulfonated fatty amides, e.g., sulfonated amide of ricinoleic acid, sodium salt of sulfuric ester of oleyl diisobutyl amide, etc.; sulfonated anilides of fats, e.g., sodium salt of sulfuric ester of oleylethyl anilide; amides of aminosulfonic acids, e.g., sodium sulfonate of oleylmethyl tauride; amides from condensation of fatty acid chlorides with amino acids, e.g., sodium salt of benzene sulfonic, naphthalene sulfonic acids and their ammonium and alkali metal salts, etc.; alkylaryl sulfonates, e.g., dodecylbenzene sulfonates, octadecylbenzene sulfonates, etc.

Illustrative nonionic surfactants include the polyethylene oxide condensates with hydrophobic groups having a reactive hydrogen. The hydrophobic group can have from about 8 to 25 carbon atoms and from 2 to about 15 molecular weights of a hydrophilic group. The hydrophobic group can be selected from a variety of organic compounds having one or more reactive hydrogens including fatty alkyl or alkenyl alcohols, fatty acids, fatty amines, fatty amides, esterified hexitans or alkyl or alkenyl phenols.

As described, the source of the hydrophilic group is ethylene oxide. Other materials can be employed, for example, ethylene chlorohydrin or polyethylene glycol; however, because of its low cost and availability, ethylene oxide is used almost exclusively in the preparation of these materials.

One class of hydrophobic group comprises alkyl or alkenyl phenols wherein the alkyl or alkenyl group or groups contain between about 2 and about 16 carbon atoms. Among such compounds are hexyl phenol, dodecenyl phenol, octenyl cresol, lauryl cresol, octenyl rescorcinol, decenyl xylenol, etc.

A second class of hydrophobic groups comprises fatty acids containing between about 12 and about 22 carbon atoms. Examples of such fatty acids are: lauric acid, palmitic acid, oleic acid, etc.

A third class of hydrophobic groups comprises the alkyl and alkenyl alcohols containing between about 8 and about 22 carbon atoms. Among such alcohols are dodecanol, tridecanol, tetradecanol, pentadecanol, hexadecenol, heptadecenol, octadecenol, docosenol, etc.

A fourth class of hydrophobic groups comprises long chain alkyl amines or alkenyl amines or amides containing between about 8 and about 22 carbon atoms. These compounds contain two reactive hydrogens, and polyethylene oxide units are distributed therebetween. Examples of such compounds are dodecanamide, tridecyl amine, tetradecenamide, pentenyl amine, hexadecyl amine, heptadecanamide, octadecyl amine, oleyl amide, etc.

Another class of suitable nonionic surfactants are the reaction products of ethylene oxide with fatty acid partial esters of hexitans. Such compounds are obtained by treating a hexitol, e.g., sorbitol, mannitol, dulcitol, etc. with a dehydrating agent to form the corresponding hexitan, i.e., sorbitan, mannitan, dulcitan, etc. The hexitan is then partially esterified with a long chain fatty acid having between about 8 and about 22 carbon atoms, such as dodecanoic acid, pentadecenoic acid, hexadecanoic acid, oleic acid, etc., to replace one of the reactive hydrogens of the hydrogens of the hexitan with the carboxylic radical. The resultant partial ester is then reacted with ethylene oxide to add the desired number of ethylene oxide units per mol of the hexital fatty ester.

Very suitable surfactants comprise the organic substituted ammonium salts of sulfodicarboxylic acids that are reacted with various hydrophobic groups such as fatty amides having 12 to 18 carbons to prepare half amides in the manner described in U.S. Pat. No. 2,976,209 or with fatty amines having 12 to 26 carbons to prepare half amides in the manner described in U.S. Pat. No. 2,976,211, or with polyethoxylated fatty amines in the manner described in U.S. Pat. No. 3,080,280, or with fatty acid esters of hydroxyl amines to obtain half amides in the manner described in U.S. Pat. No. 2,976,208. Examples of these surfactants are the following: half isobutyl amine salt, half tetraethoxyxylenol ester of sulfo-glutaric acid; half isopropyl amine salt, half triethoxy amyl phenol ester of sulfoadipic acid; half amyl amine salt, half pentaethoxy cresol ester of sulfo-pimelic acid; half hexylamine salt, half diethoxyoctyl phenol ester of sulfo-suberic acid; half isopropylamine salt, half diethoxy dodecyl phenol ester of sulfo-azelaic acid; half heptylamine salt, half diethoxy dodecyl phenyl ester of sulfosebasic acid, etc.

Any of a wide variety of finely subdivided adsorbents can be used as the solid adsorbent powder in the cleaning composition. Examples of suitable adsorbent solids include silica, alumina, or combinations of these materials. Examples include Fuller's Earth, diatomaceous earth, calcium or sodium silicates, expanded calcium silicate (pearlite), expanded sodium silicate, alumina, silica stabilized alumina containing from 1 to 15 percent silica, alumina silicates, clay, preferably an expanding lattice clay, naturally occurring or synthetically prepared zeolites, etc. Other adsorbent materials which can be used include botanical flours such as soybean flour, wheat flour, tobacco flour, cottonseed flour, walnut shell flour, wood flour, sawdust, etc. Other materials that can be used include particulate solid metal carbonates and sulfates, e.g., calcite and dolomite. Gypsum, a calcium sulfate, can also be used.

The size range of the particles can be widely varied to provide the necessary abrasive and adsorbent action. Typically solids with a weight majority, preferably ninety percent, passing a 100 mesh, and most preferably a 200 mesh sieve can be used. The use of finely subdivided solids is preferred because of the greater specific surface area such solids have, and, hence, the greater adsorbency that will be exhibited by the solids in the cleaning composition.

The following example will illustrate the cleaning compositions and serve to demonstrate the results obtainable by the method of using these cleaning compositions.

EXAMPLE

Several cleaning compositions were formulated using a non-swelling clay powder passing a 200 mesh screen, a low HLB value surfactant, Trycol N-P9, varied solvents, and a high HLB value water-in-oil surfactant, Emsorb 6900. The compositions were prepared by mixing the clay with the oil-in-water surfactant and thereafter adding a mixture of the solvent and the oil-in-water surfactant. The solvent used for the first two formulations was a mixture of a highly aromatic (kauri-butanol value about 90), high flash point (200 degrees F.) hydrocarbon solvent and cellulose acetate in weight proportions of 6/1. The cellulose acetate was used to stabilize the composition and prevent its separation before use. The third composition used dimethylformamide as the solvent. The following table summarizes the compositions:

TABLE 2

| Composition Number | Solvent | Solid | Surfactant Oil-in-Water | Surfactant Water-in-Oil |
|---|---|---|---|---|
| 1 | 56.6% | 40.4% | 2.5% | 0.5% |
| 2 | 58 | 41 | 0.3 | 0.5 |
| 3 | 54.7 | 45.1 | 0.02 | 0.01 |

The cleaning compositions were used for removal of adhesive residues left after removal of floor coverings. Each composition was tested on asphaltic and polyvinyl acetate adhesive residues on concrete subfloors. The cleaning compositions were applied at dosages of 50 square feet per gallon and were permitted to contact the residues for about twenty minutes, during which the floor surfaces were scrubbed with a broom. Thereafter, the compositions were vacuumed from the floors and the floors were washed with water and a mild detergent.

It was observed that the compositions 1 and 2 were best in overall performance, cleaning the asphaltic and polyvinyl acetate residues equally, while the composition 3 worked best on the polyvinyl acetate residues. The floors were cleaned so completely that markings which had been applied to the concrete subfloor prior to the original flooring application were clearly visible.

The invention has been described with reference to the presently preferred and illustrated embodiments. It is not intended that the invention be unduly limited by the disclosure of the illustrated and preferred embodiments. Instead, it is intended that the invention be defined by the ingredients, and the steps, and their obvious equivalents, set forth in the following claims.

I claim:

1. A method for cleaning organophilic adhesive coatings from a floor surface which comprises:

(a) applying, to the surface of a floor having used and aged residues of an adhesive selected from the class of asphaltic, polyvinyl acetate and rubber base adhesives remaining after removal of flooring tile and the like, a cleaning composition consisting essentially of;

(i) from 40 to about 80 weight percent of an organic solvent having a flash point above about 140 degrees F.;

(ii) from 20 to about 60 weight percent of an inorganic solid adsorbent powder having a particle size passing a 100 mesh screen;

(iii) a water-in-oil surfactant in an amount from 0.002 to about 0.01 weight percent, sufficient to form said cleaning composition into an oil external phase emulsion;

(iv) an oil-in-water surfactant in an amount from 0.001 to about 0.05 weight percent, sufficient to convert said oil external phase emulsion to a water external phase emulsion upon the addition of water thereto; and .

(v) no greater than 20 weight percent water;

(b) permitting said cleaning composition to remain in contact with said adhesive coating for a time sufficient to soften said adhesive;

(c) scrubbing said surface to loosen said adhesive coating and to work the loosened adhesive into said composition, forming an emulsion having a whipped consistency;

(d) adding water to said emulsion of whipped consistency in an amount greater than the volume of said cleaning composition sufficient to convert said emulsion to a water external phase emulsion; and (e) removing said water external phase emulsion from said substrate.

2. The method of claim 1 wherein said organic solvent is an aromatic solvent.

3. The method of claim 2 wherein said aromatic solvent is a naphthalene compound.

4. The method of claim 3 wherein said naphthalene compound is a chloronaphthalene.

5. The method of claim 1 wherein said water-in-oil surfactant has a HLB value from 1.8 to about 8.5.

6. The method of claim 5 wherein said oil-in-water surfactant has a HLB value from about 9 to 17.

7. The method of claim 1 wherein said inorganic solid is silica.

8. The method of claim 1 wherein said inorganic solid is an aluminosilicate.

9. The method of claim 8 wherein said aluminosilicate is a clay.

10. The method of claim 9 wherein said clay is an expanding lattice clay.

11. The method of claim 9 wherein said clay is bentonite.

12. The method of claim 1 wherein said oil-in-water surfactant is a non-ionic surfactant.

13. The method of claim 1 wherein said adhesive is polyvinylacetate.

14. A cleaning composition for removing asphaltic adhesive residues from floors which consists essentially of:

(a) from 40 to about 80 weight percent of an organic solvent having a flash point above about 140 degrees F.;

(b) from 20 to about 60 weight percent of an inorganic solid adsorbent powder having a particle size passing a 100 mesh screen;

(c) a water-in-oil surfactant in an amount from 0.002 to about 0.01 weight percent, sufficient to form said cleaning composition into an oil external phase emulsion;

(d) an oil-in-water surfactant in an amount from 0.001 to about 0.05 weight percent, sufficient to convert said oil external phase emulsion to a water external phase emulsion upon the addition of water thereto; and (e) from 0 to 20 weight percent water.

15. The composition of claim 14 wherein said organic solvent is an aromatic solvent.

16. The composition of claim 14 wherein said aromatic solvent is a naphthalene compound.

17. The composition of claim 14 wherein said naphthalene compound is a chloronaphthalene.

18. The composition of claim 14 wherein said water-in-oil surfactant is a non-ionic surfactant.

19. The composition of claim 14 containing from 0 to 2 weight percent water.

20. The composition of claim 14 wherein said inorganic solid is silica.

21. The composition of claim 14 wherein said inorganic solid is an aluminosilicate.

22. The composition of claim 21 wherein said aluminosilicate is a clay.

23. The composition of claim 22 wherein said clay is an expanding lattice clay.

24. The composition of claim 22 wherein said clay is bentonite.

25. The method of claim 1 wherein said composition contains no greater than 2 weight percent water.

* * * * *